United States Patent [19]

Shimizu et al.

[11] Patent Number: 4,932,221

[45] Date of Patent: Jun. 12, 1990

[54] AIR-COOLED COOLING APPARATUS

[75] Inventors: Yasuo Shimizu; Nobuyoshi Terada, both of Itami, Japan

[73] Assignee: Mitsubishi Denki Kabushiki Kaisha, Japan

[21] Appl. No.: 293,884

[22] Filed: Jan. 6, 1989

[30] Foreign Application Priority Data

May 9, 1988 [JP] Japan ..... 63-112914

[51] Int. Cl.[5] ..... F25D 17/00

[52] U.S. Cl. ..... 62/180; 62/98

[58] Field of Search ..... 62/185, 180, 98, 332

[56] References Cited

U.S. PATENT DOCUMENTS 3,276,516 10/1966 Japhet ..... 165/27

4,313,310 2/1982 Kobayashi et al. ..... 62/332 X

FOREIGN PATENT DOCUMENTS 1099933 4/1981 Canada ..... 62/185

0033099 2/1983 Japan ..... 62/332

OTHER PUBLICATIONS

Mitsubishi Denki, "Cooling Handbook; Air Conditioner" Mar. 31, 1988, FIG. 1, pp. 161.

*Primary Examiner*—William E. Wayner

*Attorney, Agent, or Firm*—Leydig, Voit & Mayer

[57] ABSTRACT

An air-cooled cooling apparatus for cooling a cooling liquid within a cooling pipe of a refrigeration machine comprising a cooling cycle including a coolant compressor, an air-cooled condenser, an expansion valve, and a cooler, thereby cooling liquid of the refrigeration machine. The apparatus also comprises an air-cooled heat exchanger, outdoor-temperature sensors and three-way valves for controlling the flow of the cooling liquid to be cooled. When the outdoor temperature is high, the cooling liquid is supplied to the cooler, and when the outdoor temperature is low, the compressor is shut down and the cooling liquid is isolated from the cooler and supplied to the heat exchanger to be cooled by cold outdoor air.

5 Claims, 1 Drawing Sheet

AIR-COOLED COOLING APPARATUS

BACKGROUND OF THE INVENTION

This invention relates to an air-cooled cooling apparatus and, more particularly, to an air-cooled cooling apparatus for cooling a cooling liquid flowing through a cooling pipe of a refrigeration machine much air conditioners and refrigerators.

FIG. 1 illustrates one example of a conventional air-cooled cooling apparatus for cooling a cooling liquid within a cooling pipe of a refrigeration machine, such as air conditioners and refrigerators. It is seen from FIG. 1 that the cooling apparatus comprises a coolant compressor 1 for compressing a coolant into a high temperature, high pressure coolant. The coolant compressor 1 is connected to an air-cooled condenser 2 where the coolant is condensed into a low temperature, high pressure liquid coolant. A fan 3 is usually provided in order to induce an air flow passing through the condenser 2 for rapid cooling of the coolant. The coolant condenser 2 is connected to an expansion valve 4 in which the low temperature, high pressure liquid coolant is expanded into a low temperature, low pressure coolant. The expansion valve 4 is connected to a coil cooler 5, where the low temperature, low pressure coolant supplied from the expansion valve 4 is evaporated to cool the coil cooler 5 by its evaporation latent heat. The Cooler 5 is connected to the coolant compressor 1 through an accumulator 6. Thus, the coolant circulates in a closed loop to repeat the steps of compression, condensation and evaporation to cool the cooler 5.

The cooler 5 is arranged in a heat exchanging relationship with a cooling pipe 10 of a refrigeration machine R such as an air conditioner or a refrigerator so that the cooling liquid of the refrigeration machine a flowing through the cooling pipe 10 is cooled by the cold coolant in the cooler 5. The illustrated cooling pipe 10 includes an inlet pipe 7, an outlet pipe 8 and heat exchange tubes 9 extending along the coil cooler 5 between the pipes 7 and 8. The cooling liquid thus cooled by the cooler 5 is supplied to the refrigeration machine to condition air or to chill the freezer chamber.

In an air-cooled cooling apparatus for a refrigerating machine R such as the air-conditioner and the refrigerator in which the cooling operation must continuously be achieved throughout year, the coolant compressor must be continuously operated irrespective of seasons, causing loss of a large amount of energy and making the annual running cost extravagant.

SUMMARY OF THE INVENTION

Accordingly, an object of the present invention is to provide an air-cooled cooling apparatus for cooling a cooling liquid within a cooling pipe of a refrigeration machine which can have a significant amount of operating energy.

Another object of the present invention is to provide an air-cooled cooling apparatus which can save a large amount of running cost.

Another object of the present invention is to provide an air-cooled cooling apparatus which can utilize cold outdoor air in the winter seasons to cool the coolant.

A further object of the invention is to provide an air-cooled cooling apparatus simple in structure.

With the above object in view, the air-cooled cooling apparatus of the present invention for cooling a cooling liquid within a cooling pipe of a refrigeration machine comprises a cooling cycle including a coolant compressor, an air-cooled condenser, an expansion valve, and a cooler, thereby cooling the cooling liquid of the refrigeration machine. The apparatus also comprises an air-cooled heat exchanger, outdoor-temperature sensors and three-way valves for controlling the flow of the cooling liquid to be cooled. When the outdoor temperature is high, the cooling liquid is supplied to the cooler cooled by the coolant, and when the outdoor temperature is low, the compressor is shut down and the cooling liquid is isolated from the cooler and supplied to the heat exchanger to be cooled by cold outdoor air.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
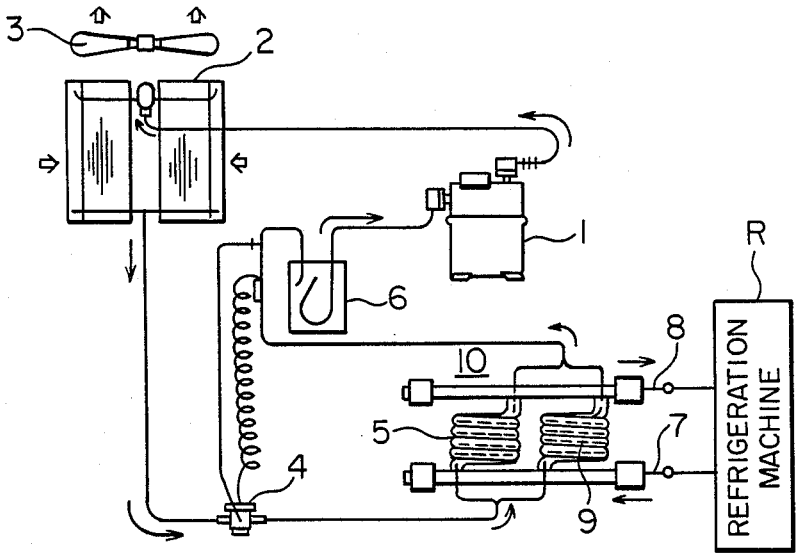
FIG. 1 PRIOR ART
FIG. 1 is a schematic diagram illustrating one example of a conventional air-cooled cooling apparatus for cooling a cooling liquid of a refrigeration machine.
Figure 2:
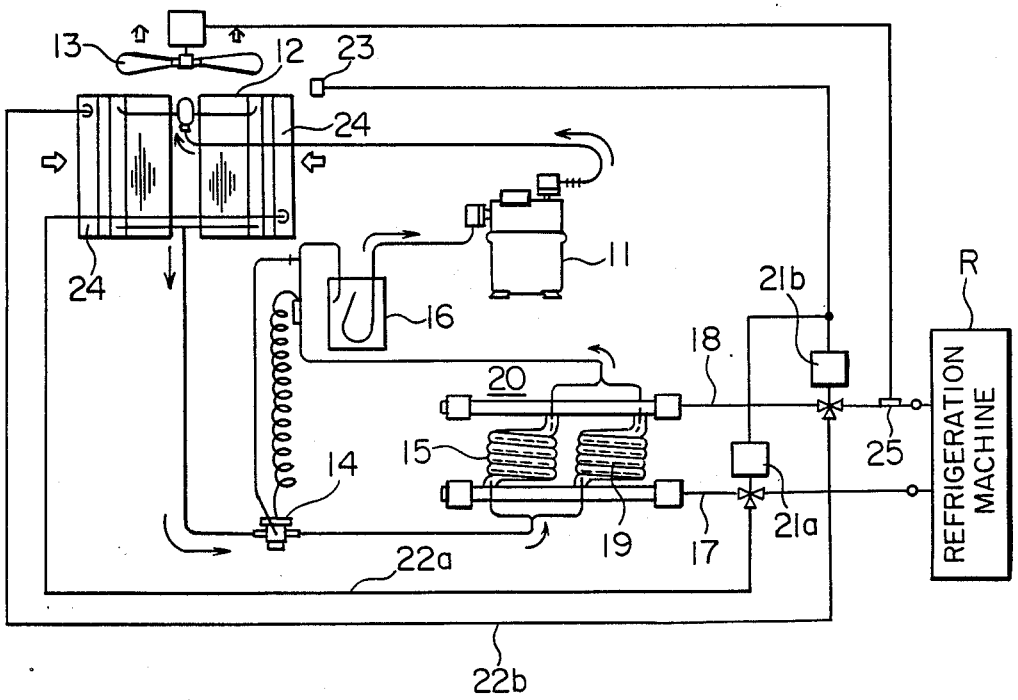
FIG. 2 is a schematic diagram illustrating one embodiment of the air-cooled cooling apparatus of the present invention.

FIG. 2 illustrates one embodiment of an air-cooled cooling apparatus for cooling a cooling liquid within a cooling pipe of a refrigeration machine R, such as air conditioners and refrigerators, of the present invention. The air-cooled cooling apparatus of the present invention comprises a coolant compressor 11 for compressing a coolant into a high temperature, high pressure coolant. The coolant compressor 11 is connected to an air-cooled condenser 12 where the coolant is condensed into a low temperature, high pressure liquid coolant. An electric fan 13 is provided in the vicinity of the condenser 12 in order to induce a flow of an outdoor air passing through the condenser 12 for rapid cooling of the coolant therein. The coolant condenser 12 is connected to an expansion valve 14 in which the low temperature, high pressure liquid coolant is expanded into a low temperature, low pressure coolant. The expansion valve 14 is connected to a cooler 15 in the form of a coil, where the low temperature, low pressure coolant supplied from the expansion valve 14 is evaporated to cool the cooler 15 by its evaporation latent heat. The cooler 15 is connected to the coolant compressor 11 through an accumulator 16. Thus, the coolant circulates in a closed loop as outlined above to repeat the steps of compression, condensation and evaporation of the coolant.

The cooler 15 is arranged in a heat exchanging relationship with a cooling pipe 20 of a refrigeration machine R such as an air conditioner or a refrigerator so that the cooling liquid of the refrigeration machine R flowing through the cooling pipe 20 is cooled by the cold coolant in the cooler 15. The illustrated cooling pipe 20 includes an inlet pipe 17, an outlet pipe 18 and heat exchange tubes 19 extending along the coil cooler 15 between the pipe 17 and 18. The cooling liquid thus cooled by the cooler 15 is supplied to the refrigeration machine R or the air conditioner (not shown) to condition air or to the refrigerator (not shown) to chill the freezer chamber.

According to the present invention, the air-cooled cooling apparatus comprises an outdoor heat exchanger 24 connected to the cooling pipe 20 of the refrigeration machine R for bringing the cooling liquid within the cooling pipe 20 into a heat exchanging relationship with an outdoor air. In the illustrated embodiment, the heat exchanger 24 is mounted to the upstream side of the condenser 12 which is installed outdoor, and is connected by a pair of pipes 22*a* and 22*b* to three-way valves 21*a* and 21*b*, respectively.

The three-way valves 21*a* and 21*b* are inserted in the inlet pipe 17 and the outlet pipe 18, respectively, of the cooling pipe 20 of the refrigeration machine R. The three-way valves 21*a* and 21*b* are connected to a temperature sensor 23 positioned in the vicinity of the outdoor heat exchanger 24 for providing a temperature signal indicative of the temperature in the vicinity of the heat exchanger 24. The three-way valves 21*a* and 21*b* are controlled by the temperature signal from the temperature sensor 23 so that they connect the refrigeration machine either to the cooler 15 (when) the temperature in the vicinity of the outdoor heat exchanger 24 exceeds a predetermined temperature value for supplying the cooling liquid of the refrigeration machine R to the cooler 15 or to the outdoor heat exchanger 24 when the temperature in the vicinity of the outdoor heat exchanger 24 is lower than the predetermined temperature value for supplying the cooling liquid from the refrigeration machine R to the outdoor heat exchanger 24. In this context, the three-way valves 21*a* and 21*b* are switching means for changing the flow paths of the cooling liquid from the refrigeration machine R.

The temperature sensor 23 is also connected to the coolant compressor 11 for providing the above-mentioned temperature signal for operating the coolant compressor 11 only when the outdoor temperature exceeds the predetermined temperature value.

The air-cooled cooling apparatus also comprises an electric fan 13 for inducing a flow of outdoor air through the coolant condenser 12 as well as through the outdoor heat exchanger 24 through which the cooling liquid from the refrigeration machine R flows.

The air-cooled cooling apparatus of the present invention further comprises a second temperature sensor 25 for detecting temperature of the cooling liquid in the cooling pipe 20 of the refrigeration machine R flowing from the cooling pipe 20 toward the refrigeration machine R. The temperature sensor 25 is attached to the outlet pipe 18 of the cooling pipe 20 to provide second temperature signal indicative of the temperature of the cooling liquid in the outlet pipe 18. The second temperature sensor 25 is connected to the electric fan 13 to provide the second temperature signal thereto to operate the fan 13 only when the temperature of the cooling liquid in the outlet pipe 18 exceeds a predetermined temperature value.

In a first mode of operation where the outdoor temperature exceeds a first set temperature value (7° C, for example) in which ordinary operating mode of the cooling apparatus is required to cool the cooling liquid of the refrigeration machine, the outdoor temperature sensor 23 allows the coolant compressor 11 and other components of the coolant circulating loop to be operated and further allows the three-way valves 21*a* and 21*b* to connect the refrigeration machine R to the cooler 15. Therefore, the cooling liquid from the refrigeration machine R flows through the three-way valve 21*a*, the inlet pipe 17, the heat exchange tubes 19, the outlet pipe 18 and through the three-way valve 21*b* back into the refrigeration machine R. Thus, the cooling liquid is cooled by the cooler 15. The fan 13 mounted on the condenser 12 may be operated when the temperature of the cooling liquid flowing through the outlet pipe 18 toward the refrigeration machine R detected by the second temperature sensor 25 exceeds 15° C. The operation of the fan 13 may not be necessary when the temperature of the cooling liquid is lower than 13° C.

In the second mode of operation, in which the outdoor temperature is equal to or lower than the set temperature value (5° C, for example) as in the winter season, the three-way valves 21*a* and 21*b* are switched by the temperature sensor 23 to connect the refrigeration machine R to the outdoor heat exchanger 24. Therefore, the cooling liquid flows from the refrigeration machine R through the three-way valve 21*a*, the pipe 22*a*, the outdoor heat exchanger 24, the return pipe 22*b* and through the three-way valve 21*b* back to the refrigeration machine R. Thus, in this mode of operation, the cooling liquid flows to the heat exchanger 24 to be cooled by the cold outdoor air, and the refrigeration cycle of the coolant including the coolant compressor 11, the condenser 12, the expansion valve 14, the cooler 15 and the accumulator 16 is shut down by the temperature signal from the temperature sensor 23.

In this operating mode also, the fan 13 mounted on the condenser 12 may be operated according to the temperature condition of the cooling liquid flowing through the outlet pipe 18 of the cooling pipe 20 toward the refrigeration machine R detected by the second temperature sensor 25.

As has been described, since the cooling liquid is cooled by the cold outdoor air when the outdoor air is cold such as in the winter season, the need for using the coolant cooling unit is reduced and the electric power consumption can be accordingly significantly decreased. Also, since the additional components necessary for providing the functions of the present invention as previously described are relatively simple and small in number, additional installation of such the components to an already installed conventional air-cooled cooling apparatus can be readily achieved.

What is claimed is:

1. An air-cooled cooling apparatus for cooling a cooling liquid within a cooling pipe of refrigeration machine, comprising:

a coolant compressor for compressing a coolant;

an air-cooled condenser connected to said coolant compressor for condensing the coolant supplied from said coolant compressor;

an expansion valve connected to said coolant condenser for expanding the coolant from said coolant condenser;

a cooler connected between said expansion valve and said compressor, said cooler being disposed in a heat exchanging relationship with the cooling pipe of the refrigeration machine, for cooling the cooling liquid of the refrigeration machine flowing through the cooling pipe;

an outdoor heat exchanger connected to the cooling pipe of the refrigeration machine for bringing the cooling liquid within the cooling pipe into a heat exchanging relationship with an outdoor air;

means for detecting air temperature in the vicinity of said outdoor heat exchanger and for providing a temperature signal indicative of the temperature in the vicinity of said outdoor heat exchanger;

switching means connected in the cooling pipe of the refrigeration machine and to said outdoor heat exchanger for selectively and exclusively routing the cooling liquid of the refrigeration machine either to said cooler when said temperature in the vicinity of said outdoor heat exchanger exceeds a predetermined temperature value or to said outdoor heat exchanger when said temperature in the vicinity of said outdoor heat exchanger is lower than said predetermined temperature value; and means connected to said coolant compressor for operating said compressor only when said temperature exceeds said predetermined temperature value.

2. An air-cooled cooling apparatus as claimed in claim 1, further comprising a fan for inducing a flow of outdoor air through said coolant condenser.

3. An air-cooled cooling apparatus as claimed in claim 2, wherein said out door heat exchanger is mounted to said coolant condenser to be exposed to said flow of outdoor air induced by said fan.

4. An air-cooled cooling apparatus as claimed in claim 1, wherein said switching means is a three-way valve.

5. An air-cooled cooling apparatus for cooling a cooling liquid within a cooling pipe of a refrigeration machine comprising:

a coolant compressor for compressing a coolant;

an air-cooled condenser connected to said coolant compressor for condensing the coolant supplied from said coolant compressor;

a fan for inducing a flow of outdoor air through said coolant condenser;

means for detecting temperature of the cooling liquid in the cooling pipe of the refrigeration machine flowing toward the refrigeration machine and for providing a signal indicative of the temperature of the cooling liquid flowing therethrough and means for operating said fan only when the temperature of the cooling liquid exceeds a predetermined temperature value;

a cooler connected between said expansion valve and said compressor, said cooler being disposed in a heat exchanging relationship with the cooling pipe of the refrigeration machine, for cooling the cooling liquid of the refrigeration machine flowing through the cooling pipe;

an outdoor heat exchanger connected to the cooling pipe of the refrigeration machine for bringing the cooling liquid within the cooling pipe into a heat exchanging relationship with outdoor air;

means for detecting air temperature in the vicinity of said outdoor heat exchanger and for providing a temperature signal indicative of the temperature in the vicinity of said outdoor heat exchanger;

switching means connected in the cooling pipe of the refrigeration machine and to said outdoor heat exchanger for selectively supplying the cooling liquid of the refrigeration machine either to said cooler when said temperature in the vicinity of the outdoor heat exchanger exceeds a predetermined temperature value or to said outdoor heat exchanger when said temperature in the vicinity of said outdoor heat exchanger is lower than said predetermined temperature value; and means connected to said coolant compressor for operating said compressor only when said temperature exceeds said predetermined temperature value.

* * * * *